United States Patent [19]

Budnik

[11] 4,439,722

[45] Mar. 27, 1984

[54] FERRORESONANT POWER SUPPLY STABILIZER CIRCUIT FOR AVOIDING SUSTAINED OSCILLATIONS

[75] Inventor: Brian J. Budnik, Schaumburg, Ill.

[73] Assignee: Motorola, Inc., Schaumburg, Ill.

[21] Appl. No.: 374,221

[22] Filed: May 3, 1982

[51] Int. Cl.[3] ..... G05F 3/06

[52] U.S. Cl. ..... 323/248; 307/34; 307/39; 363/75; 323/225

[58] Field of Search ..... 363/50, 53, 75, 90; 323/223, 226, 233, 248, 309; 307/32, 34, 39; 361/56

[56] References Cited

U.S. PATENT DOCUMENTS

| | | | |
|---|---|---|---|
| Re. 27,916 | 2/1974 | Kakalec | 323/61 |
| 3,351,849 | 11/1967 | Mesenhimer | 323/45 |
| 3,401,272 | 8/1965 | Rosa et al. | 307/93 |
| 3,524,124 | 8/1970 | Perkinson | 361/56 |
| 3,573,605 | 4/1971 | Hart et al. | 323/56 |
| 3,573,606 | 4/1971 | Hart et al. | 323/60 |
| 3,812,415 | 5/1974 | Van Gilder et al. | 320/31 |
| 3,824,449 | 7/1974 | Hase | 326/6 |
| 3,916,295 | 10/1975 | Hunter | 323/50 |
| 3,965,408 | 6/1976 | Higuchi et al. | 321/25 |
| 4,030,025 | 6/1977 | Kakalec | 323/61 |
| 4,359,679 | 11/1982 | Regan | 363/56 |

FOREIGN PATENT DOCUMENTS

| | | | |
|---|---|---|---|
| 242096 | 1/1963 | Australia | 363/90 |
| 1513599 | 10/1969 | Fed. Rep. of Germany | 307/39 |
| 55-82317 | 6/1980 | Japan | 363/36 |

OTHER PUBLICATIONS

Fitzsimmons, "Transistor Replaces Bleeder and Regulates Power Supply," Electronics, vol. 41, No. 2, pp. 70, 71, Jan. 1968.

Hemena, "Ferro-Resonant Transformer with Power Supply Regulation," IBM Tech. Discl. Bull., vol. 22, No. 7, pp. 2903, 2904, Dec. 1979.

*Primary Examiner*—William H. Beha, Jr.

*Attorney, Agent, or Firm*—Joan Pennington; John B. Conklin; James W. Gillman

[57] ABSTRACT

A stabilization circuit is provided for use with a ferroresonant power supply to maintain a steady output voltage during power line transients, rapid load changes, or no load condition. The stabilization circuit is responsive to the voltage output of the power supply and selectively connects a load across voltage output terminals. Stabilization circuit includes a voltage sensing circuit that enables a timing circuit that activates a switch to place the load across terminals. This stabilizes the power supply, without requiring a continuously dissipative minimum load.

4 Claims, 3 Drawing Figures

FERRORESONANT POWER SUPPLY STABILIZER CIRCUIT FOR AVOIDING SUSTAINED OSCILLATIONS

BACKGROUND OF THE INVENTION

This invention relates to ferroresonant voltage regulating circuits and in particular to a DC power supply which uses a ferroresonant power transformer to achieve voltage regulation, and which incorporates a stabilizer circuit to eliminate instabilities in the power supply under certain common operating conditions.

Ferroresonant regulators presently find widespread use in the power supply field. Ferroresonant devices utilize transformer saturation to obtain regulation over line voltage changes. Secondary saturation insures that the secondary voltage cannot increase beyond a certain value, independent of variations in primary (input) voltage.

Among the many advantages of ferroresonant power supplies the most important probably is their excellent voltage regulation during static and dynamic line voltage changes. In addition, ferroresonant power supplies are reliable, of relatively low cost, simple in structure and of small size. They have inherent short circuit protection, good efficiency and a high input power factor.

In operation when the AC input voltage to the ferroresonant transformer is high enough the transformer core under the secondary winding saturates at a point in each AC half-cycle. Further increases in line voltage beyond the saturation point are absorbed by primary inductance. Therefore, the secondary voltage remains constant over changes in line voltage. A more detailed description of ferroresonance and its application to regulated power supplies can be found in Transformer and Inductor Handbook, William T. McLyman, Marcel Dekker, Inc. (1978), which is incorporated by reference, as if fully set forth herein.

Traditional ferroresonant power supplies use a high power bleeder resistor to dampen oscillatory tendencies of the power supply at a light or no load condition. Without the bleeder resistor, occurrences such as line interrupts, transients or abrupt removal of the output load can easily send the ferroresonant power supply into unstable oscillation. In fact, it is not uncommon for a ferroresonant power supply to enter an unstable oscillatory mode in a no load condition, even in the absence of a line transient or interrupt. When a ferroresonant power supply goes into an unstable oscillatory condition, the DC output voltage of the supply can easily reach three to five times its normal magnitude. Such levels of output voltage can damage circuits that depend on a regulated voltage from the ferroresonant power supply.

In order to provide sufficient damping to prevent the ferroresonant power supply from entering an unstable oscillatory state, a minimum load current of about 5% to 10% of the maximum rated load current must be maintained. To accomplish this, the prior art has traditionally used a large bleeder resistor to guarantee such a minimum current output under no load conditions. However, the bleeder resistor used in the prior art dissipates power continuously even at full load where it is unnecessary. The presence of a bleeder resistor, which consumes up to 10% of the available output power from the ferroresonant power supply, creates significant heat in the area of the ferroresonant power supply in high power applications. The generated heat may be sufficient to require a fan or heat sink to dissipate the heat away from the regulator, or it may require oversized power components.

Operation of a ferroresonant power supply under such conditions is undesirable since the energy loss in the bleeder resistor required for stability purposes represents a reduced efficiency of the power supply which is otherwise of high efficiency. In addition, equipment such as a fan or heat sink required to dissipate the heat generated by the bleeder resistor add cost to an otherwise relatively inexpensive ferroresonant power supply. High efficiency and low cost are two of the most desirable features of a ferroresonant power supply. Therefore, there is a need for a ferroresonant power supply which can operate stably over a no load to full load range without requiring the continuous dissipation of a portion of the total regulator output into a bleeder resistor.

An object of this invention is to provide a new and improved construction of a ferroresonant power supply which maintains operational stability over input line transients and rapid variations in output load without the need of a continuous minimum power dissipation.

A further object of this invention is to provide a stabilizer circuit for a ferroresonant power supply which minimizes the need for a bleeder resistor to stabilize the power supply output.

SUMMARY OF THE INVENTION

The invention is a stabilizer circuit which allows a ferroresonant power supply to maintain a relatively steady output voltage during input power line transients or interrupts, rapid load changes, or no load conditions without requiring a continuously dissipative minimum load. In the power supply a saturating transformer is responsive to an input signal. A secondary circuit is responsive to the saturating transformer and outputs a regulated voltage. A stabilization circuit responsive to the regulated output voltage temporarily places a load across the secondary circuit output when the stabilization circuit senses a unstable condition. The stabilization circuit is composed of a sensing circuit, a timing circuit, a switch and a load. The sensing circuit senses an unstable condition at the secondary circuit output. When such a condition is detected, the timing circuit is activated by the sensing circuit. The timing circuit activates the switching means to place the load across the output of the secondary circuit for a time period determined by the timing circuit and the sensing circuit. The presence of the load brings the ferroresonant power supply out of the unstable condition and returns the regulated voltage output within an acceptable range.

DETAILED DESCRIPTION OF THE INVENTION

Figure 1:
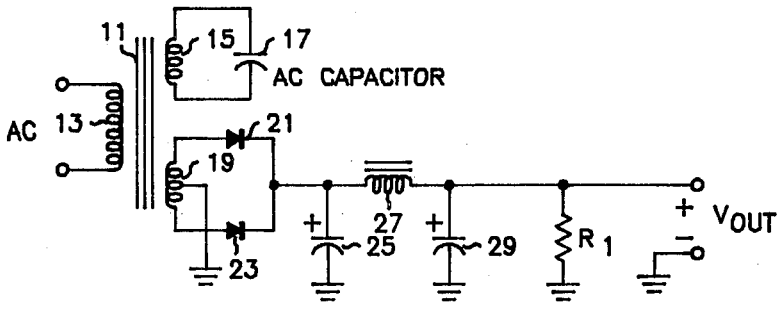
PRIOR ART Fig. 1
FIG. 1 is a circuit diagram of a traditional ferroresonant voltage regulated power supply utilizing a bleeder resistor to maintain operational stability.

FIG. 1 shows the prior art diagram of a ferroresonant voltage regulated power supply. A ferroresonant transformer 11 is generally represented in FIG. 1. A primary winding 13 supplies an AC input voltage to the transformer core 11. A first secondary winding 15 of transformer 11 is shunted by a AC capacitor 17. The first secondary winding 15 and the AC capacitor 17 function to provide voltage regulation in a manner commonly known to those familiar with ferroresonant regulators and power supplies. A second secondary winding 19 with a grounded center tap has a full-wave rectifier connected across the two end points of the secondary winding 19. The full-wave rectifier is defined by diodes 21 and 23. The output of the rectifier is filtered by a filter network comprising capacitor 25, inductive choke 27 and a second capacitor 29. The output of the filter network is a low ripple DC voltage which is regulated with respect to variations in AC input voltage across primary winding 13.

Without a load present at the output of the power supply in FIG. 1, slight input line voltage transients or input line interrupts can cause the power supply to enter a state of sustained oscillation. In fact, it is not uncommon for the voltage regulated power supply of FIG. 1, in a no load condition, to enter a unstable oscillatory state without an external cause. In order to provide sufficient damping for the voltage regulated power supply of FIG. 1 to prevent it from entering an unstable state, a resistor R1 must be provided between the DC output of the filter network to the power supply ground. The resistor R1 functions as a bleeder resistor which maintains a minimum load at the regulated output. The resistor R1 approximately draws between four and ten percent of the maximum rated load current of the power supply. As an example, for a 500 watt ferroresonant voltage regulated power supply with a nominal maximum output rating of 36 amps at 13.8 VDC, the bleeder resistor R1 would need to be 10 ohms or less in order to dissipate approximately four percent of the nominal maximum output load. If the ferroresonant power supply in its unloaded condition has a DC output voltage of 17 volts, the dissipation in the resistor R1 during a standby condition would be $(17)^2/10=29$ watts. Therefore, resistor R1 would need to be approximately rated at 60–75 watts. At full load, with a DC output voltage of approximately 13.8 volts the resistor R1 would be consuming approximately $(13.8)^2/10=19$ watts. This is a significant power loss over the normal full operational range of a device known for its high efficiency. Moreover, the resistor R1 generates considerable amount of heat in the physical area surrounding the ferroresonant power supply. Therefore, dissipation means must be provided to prevent the possible overheating of the ferroresonant power supply. In addition a larger transformer and rectifier may be required to supply the additional current to R1 over and above the normal full load output requirements. The desirable characteristics of a ferroresonant voltage regulated power supply of low cost and comparably high efficiency are eroded by the need to waste useful power available at the output of the ferroresonant power supply by way of dissipation through bleeder resistor R1, by the need to provide a means to compensate for the heat generated by the bleeder resistor R1 and by the oversized components necessary to deliver current to R1 at full load.

Figure 2:
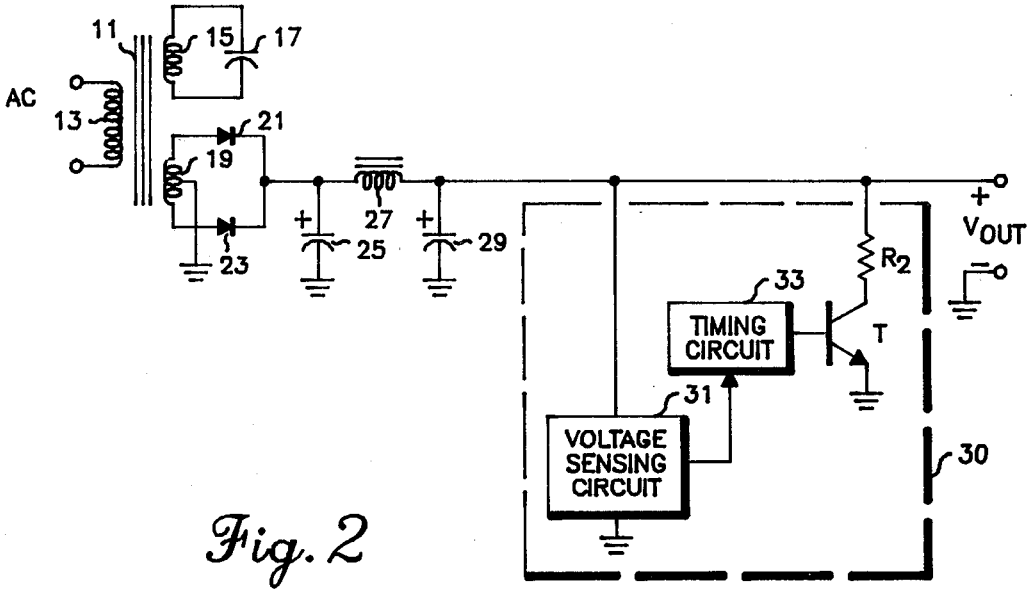
FIG. 2 is a circuit diagram of a ferroresonant power supply with a stabilizing circuit according to the invention.

FIG. 2 shows a ferroresonant power supply with a stabilizing circuit according to the invention. The ferroresonant power supply of FIG. 2 contains all the same component parts as the prior art ferroresonant power supply shown in FIG. 1. Accordingly, all the component parts common to FIG. 1 and FIG. 2 are numbered identically. According to the invention as shown in FIG. 2, the bleeder resistor R1 of FIG. 1 has been replaced by a stabilization circuit 30.

The stabilization circuit 30 comprises a voltage sensing circuit 31, a timing circuit 33, a transistor T and resistive element R2. When the power supply enters an unstable oscillatory state, the output voltage becomes considerably greater than normal. The voltage sensing circuit 31 senses this higher than normal voltage at the output of the ferroresonant power supply. When such a higher voltage is sensed, the timing circuit 33 is activated which in turn activates transistor T which acts to apply a resistive element R2 across the output of the ferroresonant power supply before the output voltage increases too far above normal. The timing circuit 33 keeps transistor T either fully saturated or completely off, thereby acting as a switch for the resistive element R2.

The stabilizing circuit is designed so that transistor T is quickly turned fully on or off. This keeps the heat dissipation at a sufficiently low level to allow the transistor T operate without the need of any costly heat sinking. The value of resistor R1 is chosen to provide a load current sufficient to bring the ferroresonant power supply out of the unstable oscillation state sensed by the stabilization circuit 30. It should be noted that any type of solid state or electromechanical switch can be used in place of transistor T.

The timing circuit 33, in response to voltage sensing circuit 31, applies drive to transistor T to switch the resistive element R2 into the ferroresonant power supply circuit for a time period determined by timing circuit 33. The resistive element R2 is switched into the ferroresonant power supply circuit by transistor T only when it is necessary to dampen oscillation sensed by the voltage sensing circuit 31. From experimental observation, it has been determined that with absolutely no load on the output of the power supply the resistive element R2 is applied across the power supply output with at most a 5% duty cycle over a given period of time in which the power supply is tending toward an unstable state. Therefore the resistive element is only applied to the unloaded power supply output for at most 5% of a given time period. In comparison, the bleeder resistor R1 of prior art FIG. 1 is applied to the power supply output for 100% of a given time period. Therefore the invention allows stability of the ferroresonant power supply to be maintained while reducing the power wasted by a bleeder resistor by 95% at no load and by 100% at full load.

The circuit shown in FIG. 2 can typically handle 20 to 30 seconds of a continuous succession of line interrupts, certainly more than is likely to be required in the event of a lighting strike, momentary power failure or any other possible causation. When a ferroresonant power supply is part of a system it is not unusual that under standby conditions the load supplied by system standby circuitry alone is sufficient to be the 4 to 10% of the full load needed to maintain stability. In such a case, a bleeder resistor load is only required to maintain stability under a fault condition (i.e. standby load fuses blow) or in instances of a service technician energizing the ferroresonant power supply while disconnected from the standby circuitry. When the resistive element R2 is needed to bring the ferroresonant power supply back into a stable condition, it is only needed for a period of time sufficient to return the ferroresonant power supply to stable operation, thus significantly reducing the amount of average power required to be bled from the output. For instance, it has been found that for a ferroresonant power supply design of 36 amperes, a very light load (less than 50 milliamperes) will typically keep the power supply stable in the absence of line interrupts or transients.

Figure 3:
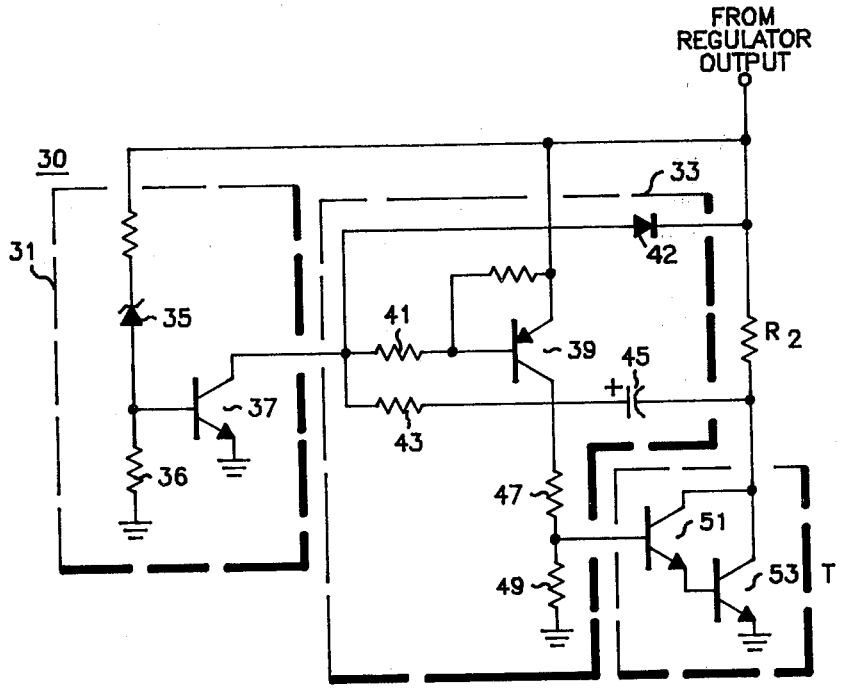
FIG. 3 is a component circuit diagram of the stabilizer circuit according to the invention shown in FIG. 2.

FIG. 3 shows a detailed component circuit diagram of the stabilization circuit shown in FIG. 2. Voltage sensing circuit 31 is composed of a zener diode 35, a resistor 36 and NPN transistor 37. Timing circuit 33 is composed of PNP transistor 39, resistors 41, 43, 47, 49 and capacitor 45. Transistor T is a darlington configuration composed of transistors 51 and 53. Oscillation is detected by a rise in the power supply output voltage above normal limits. When this occurs zener diode 35 raises the base voltage on transistor 37 causing the voltage on the collector of transistor 37 to be pulled low. This causes transistor 39 to turn on and provide base current for transistor T. With the collector of transistor 39 providing base current, the transistor T turns on with positive feedback through capacitor 45 to rapidly saturate the darlington configuration transistors 51 and 53. With the collector to emitter voltage of transistor 53 at approximatey 1 volt, nearly the full voltage at the output of the ferroresonant power supply is applied across resistor R2, thus producing a load at the power supply output without dissipating sufficient power in transistor 53 to require a heat sink. R2 is chosen to provide a load current sufficient to bring the ferroresonant power supply out of oscillation and discharge the filter network capacitors 25 and 29, and yet not exceed the current rating of transistor 53.

After the power supply output drops below the trigger voltage defined by the breakdown voltage of zener diode 35, transistor 37 is turned off and capacitor 45 begins to charge through resistors 41 and 43. The charging of capacitor 45 maintains base current in transistor 39 for a predetermined period after power supply output voltage drops below the trigger voltage. As a result transistor T is kept on for a sufficient period of time to assure the ferroresonant power supply is brought back to stable operation after the output voltage is returned to within a normal range. When capacitor 45 approaches full charge the base current in transistor 39 becomes too small to hold the transistor T biased on. The collector voltage of the transistor T begins to rise. This causes a positive feedback through the capacitor 45 and further reduces the base current in transistor 39, thus rapidly turning off transistor T. The collector voltage on transistor 53 then rapidly rises, forcing capacitor 45 to discharge through resistor 43 and diode 42, resetting the timing circuit.

Since the transistor T is turned fully on and fully off rapidly, nearly all of the power dissipation takes place in resistive element R2. Therefore, transistor 53 should not require a heat sink even though it may be conducting high current levels. The average power dissipated in resistive element R2 is relatively small compared to the instantaneous power it dissipates since the stabilization circuit is not energized frequently. Therefore the wattage rating of resistive element R2 may be small. As an example, it has been found that a 10 watt resistor is adequate for even the most extreme line transient and line interrupt conditions on the input AC line even though the power dissipated in the resistor during the brief interval the stabilization circuit is energized is approximately 72 watts.

I claim:

1. A method for stabilizing the output of a ferroresonant power supply to avoid sustained oscillations comprising the steps of:

(1) sensing the output of said power supply, (2) switching a load across the output of said power supply when an unstable output is detected, and (3) rapidly removing said load when a predetermined minimum period of time has elapsed after a stable output is detected.

2. A circuit for stabilizing a ferro-resonant power supply during input line transients or interrupts, rapid load changes, or no load conditions, said circuit comprising:

a sensing circuit responsive to the voltage output of the power supply and providing a control signal when an unstable voltage output condition is detected, a timing circuit responsive to said control signal and extending the duration thereof for a predetermined minimum period of time for providing a second control signal, switching means rapidly responsive to said second control signal, and means responsive to said switching means to create a stabilizing load at the output of said power supply.

3. A circuit for stabilizing a ferroresonant power supply according to claim 2 wherein said sensing circuit comprises, a voltage sensing element with a threshold voltage that is greater than the normal output voltage from said power supply and less than the maximum acceptable output voltage from said power supply.

4. A circuit for stabilizing a ferroresonant power supply according to claim 2 wherein said timing circuit comprises:

a switching transistor activated by said control voltage and coupled to an RC network whose charging rate defines the minimum period of time said means responsive to said switching means is connected across the power supply output.

* * * * *